US010247055B2

(12) United States Patent
De Oliveira Ghiraldi et al.

(10) Patent No.: US 10,247,055 B2
(45) Date of Patent: Apr. 2, 2019

(54) CAM PHASER HAVING A RETENTION FEATURE FOR AIDING ASSEMBLY

(71) Applicant: Schaeffler Technologies AG & Co. KG, Herzogenaurach (DE)

(72) Inventors: Renato De Oliveira Ghiraldi, Madison Heights, MI (US); Alexandre Camilo, Troy, MI (US); Peter Cantin, Harrison Township, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 115 days.

(21) Appl. No.: 15/406,185

(22) Filed: Jan. 13, 2017

(65) Prior Publication Data

US 2018/0202328 A1 Jul. 19, 2018

(51) Int. Cl.
*F01L 1/46* (2006.01)
*F01L 1/344* (2006.01)

(52) U.S. Cl.
CPC ..... *F01L 1/34416* (2013.01); *F01L 1/3442* (2013.01); *F01L 1/46* (2013.01); *F01L 2001/34423* (2013.01); *F01L 2001/34453* (2013.01); *F01L 2001/34469* (2013.01); *F01L 2001/34483* (2013.01); *F01L 2103/00* (2013.01); *F01L 2250/02* (2013.01)

(58) Field of Classification Search
CPC ..... F01L 2001/3445; F01L 2001/34453; F01L 2001/34469; F01L 1/46
USPC ..... 123/90.17
See application file for complete search history.

(56) References Cited

U.S. PATENT DOCUMENTS 8,904,980 B2 * 12/2014 Hayashi ..... F01L 1/3442 123/90.15
2003/0196627 A1 * 10/2003 Lewis ..... F01L 1/34 123/90.17
2006/0086332 A1 * 4/2006 Simpson ..... F01L 1/022 123/90.17
2010/0064997 A1 3/2010 Ai
2011/0061616 A1 3/2011 Watanabe
2013/0312684 A1 * 11/2013 Boesel ..... F01L 1/344 123/90.17
2015/0013636 A1 1/2015 Boese et al.
2015/0292367 A1 * 10/2015 Bayrakdar ..... F01L 1/3442 123/90.17

(Continued)

FOREIGN PATENT DOCUMENTS

KR 10 2009 0074161 A 7/2009

*Primary Examiner* — Jorge Leon, Jr.
(74) *Attorney, Agent, or Firm* — Volpe and Koenig. P.C.

(57) ABSTRACT

A cam phaser has a stator, a rotor positioned in the stator and including a locking pin, a locking cover including a receiving feature for receiving the locking pin, a cover plate, and a check valve plate positioned between the stator and the locking cover and including a plurality of valve elements. The cam phaser also has a plurality of first openings in each of the stator, locking cover, and check valve plate, a plurality of second openings in the locking cover, and a third opening formed in the check valve plate. The cam phaser further includes a retention feature for aligning components of the cam phaser during assembly, the retention feature including one or more tabs on a first component and one or more indentations on a second component receiving the one or more tabs.

19 Claims, 3 Drawing Sheets

(56) References Cited

U.S. PATENT DOCUMENTS

| | | | | |
|---|---|---|---|---|
| 2016/0010516 | A1* | 1/2016 | Suzuki | F03C 2/30<br>123/90.12 |
| 2016/0169060 | A1* | 6/2016 | Fischer | F01L 1/3442<br>123/90.17 |

* cited by examiner

CAM PHASER HAVING A RETENTION FEATURE FOR AIDING ASSEMBLY

FIELD OF INVENTION

The present invention relates to a cam phaser, and, more particularly, to a cam phaser having a retention feature for aiding assembly.

BACKGROUND

Cam phasers include nesting and adjacent components which must be aligned in certain relative radial positions during assembly. Proper alignment is needed, for example, to ensure an oil path is created through corresponding openings in the components. During assembly, some components, such as a check valve plate, are loosely positioned while other components are moved into place. These loose components may inadvertently move and rotate as other components are added, complicating the assembly process, rendering handling of the parts difficult, and possibly resulting in assembled devices that have misaligned parts.

The present disclosure is directed to overcoming these and other problems of the prior art.

SUMMARY

In one aspect, the present disclosure is directed to a cam phaser. The cam phaser includes a stator, a rotor positioned in the stator and including a locking pin, a locking cover including a receiving feature for receiving the locking pin, a cover plate on an opposite side of the stator from the locking cover, and a check valve plate positioned between the stator and the locking cover and including a plurality of valve elements. The cam phaser also has a plurality of first openings in each of the stator, locking cover, and check valve plate, a plurality of second openings in the locking cover, and a third opening formed in the check valve plate. The cam phaser further includes a retention feature for aligning components of the cam phaser during assembly, the retention feature including one or more tabs on a first component, for example the check valve plate, and one or more indentations on a second component, for example the locking cover and/or the stator, located in complementary positions to and receiving the one or more tabs.

In a further aspect, the retention feature helps to keep at least some of the components of the cam phaser aligned. In the assembled cam phaser, the check valve plate is aligned with the stator, the rotor, and the locking cover such that the plurality of first openings are aligned for receiving a fastener, the plurality of second openings are aligned with the plurality of valve elements, and the third opening is aligned with a receiving feature such that the locking pin is configured to extend through the third opening into the receiving feature.

In another aspect the present disclosure is directed to a method of assembling a cam phaser. The method includes positioning a stator, a rotor, a locking cover, and a check valve plate with respect to each other. As a result of the positioning of these components, a plurality of first openings in the stator, locking cover, and check valve plate are aligned for receiving a fastener, a plurality of second openings in the locking cover are aligned with a plurality of valve elements of a check valve plate, and a third opening in the check valve plate is aligned with a receiving feature in the locking plate such that a locking pin on the rotor is configured to extend through the third opening into the receiving feature. Moreover, positioning at least the check valve plate with respect to at least one of the stator or the locking cover includes inserting one or more tabs on a first component into one or more indentations on a second component in order to align the first and second components with each other.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
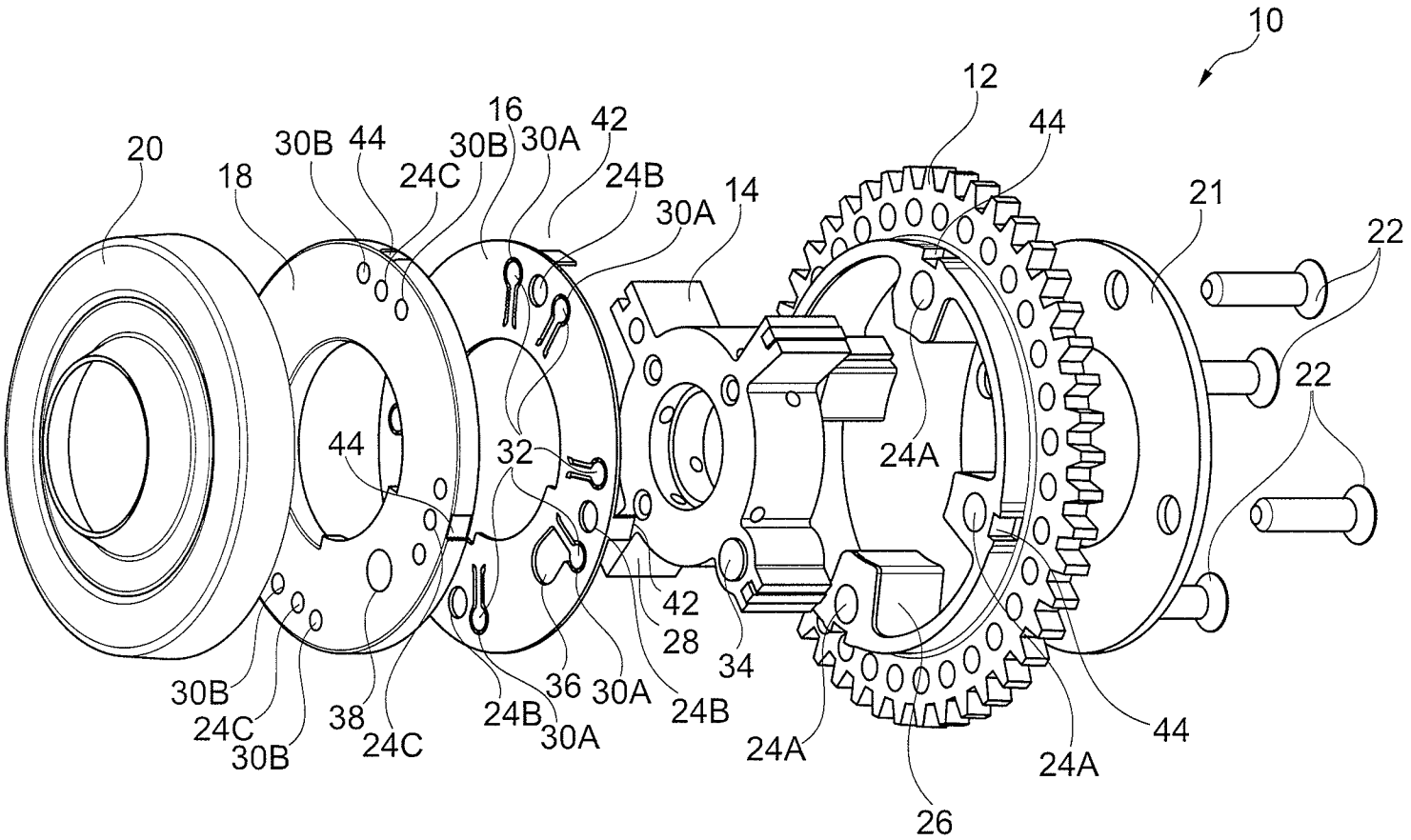
FIG. 1 is an exploded view of an exemplary cam phaser.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

FIG. 1 illustrates an exploded view of an exemplary cam phaser 10. The cam phaser 10 is preferably used in conjunction with an engine, such as an internal combustion engine, in order to vary valve timing in a manner known in the art (e.g., through hydraulic pressure). The cam phaser 10 preferably includes at least a stator 12, a rotor 14, a check valve plate 16, and a locking cover 18. In some embodiments, the cam phaser 10 also includes a front cover plate 20 and a rear cover plate 21. The cam phaser 10 may include additional components not described here depending on the application. For example, some configurations may include components such as a solenoid, one or more springs, a locking pin, housing parts, cam parts, a shaft, etc.

As shown in FIG. 1, the check valve plate 16 may be generally positioned between the locking cover 18 and the stator 12. The rear cover plate 21 is positioned on an opposite side of the stator 12 from the locking cover 18. In an alternative embodiment, depending on the configuration of the cam phaser 10, the check valve plate 16 may be positioned between the stator 12 and the rear cover plate 21.

In one embodiment, the cam phaser 10 further includes a plurality of fasteners 22. The plurality of fasteners 22 are preferably bolts which hold at least some of the components of the cam phaser 10 together. For example, at least the stator 12, check valve plate 16, and locking cover 18 each include a plurality of first openings 24A, 24B, 24C, respectively, for receiving the fasteners 22. During assembly, the first openings 24A, 24B, 24C must be aligned in order to allow the fasteners 22 to pass through all of the components.

As shown in FIG. 1, the stator 12 includes an internal space for receiving the rotor 14. Cavities are formed between respective lobes 26 of the stator 12 and vanes 28 of the rotor 14 when the rotor 14 is positioned in the stator 12. The cam phaser 10 further includes components (e.g., fluid supply, solenoid valve, etc.) which allow a fluid to be selectively introduced into the cavities in order to rotate the rotor 14 within the stator 12, in a manner known in the art, in order to adjust the phase of a cam shaft relative to a crankshaft. In order to introduce the fluid into the cavities, one or more axial channels are formed within the cam phaser 10. The axial channels are formed at least in part by a plurality of cutouts 30A in the check valve plate 16 and a plurality of second openings 30B in the locking cover 18. The cutouts 30A form a plurality of one-way valve elements 32. In an embodiment in which the check valve plate 16 is positioned between the stator 12 and the rear cover plate 21, the rear cover plate 21 may include openings which are aligned with the cutouts 30A in the check valve plate 16.

In order to control the flow of fluid from the cavities, the one-way valve elements 32 in the cutouts 30A must be properly aligned with the openings 30B during assembly of the cam phaser 10. In addition, the check valve plate 16 must face a proper axial direction for proper alignment of the one-way valve elements 32 if the same valve plate 16 is to be used as a universal part for different cam phasers, such as an intake phaser or an exhaust phaser.

The cam phaser 10 further includes a locking pin 34 positioned in a vane 28 of the rotor 14. The locking pin 34 selectively locks the rotor 14 to the locking cover 18 to fix the rotor 14 relative to the stator 12. For example, the locking pin 34 is forced by a spring through a third opening 36 in the check valve plate 16 and into a receiving feature 38 in the locking cover 18. In order to allow proper functioning of the locking pin 34, the check valve plate 16 and the locking cover 18 must be aligned during assembly such that the third opening 36 and the receiving feature 38 are aligned with each other.

The receiving feature 38 may be any integral or separate component part of the locking cover 18 which is configured to receive an end of the locking pin 34. For example, the receiving feature 38 may be a bushing which is inserted in an opening, bore, or aperture in a body of the locking cover 18. The bushing may be cylindrical, cup-shaped, open-ended, etc. In another example, the receiving feature 38 may be a fine-blanked hole formed in the body of the locking cover 18 or an indentation. The hole may be heat-treated to attain a hardness suitable for receiving the locking pin 34. In yet another example the receiving feature 38 may be a hardened insert placed in a receiving aperture formed within the locking cover 18 to serve as a reception area for the locking pin 34.

Proper assembly of the cam phaser 10 thus requires alignment of the first openings 24A, 24B, 24C, the plurality of cutouts 30A and valve elements 32 with the plurality of second openings 30B, and the third opening 36 and receiving feature 38. During an assembly process, especially a manual assembly process, it may be difficult to keep all of the components of the cam phaser 10 in their proper relative positions and install the fasteners 22. In order to ensure proper alignment during assembly, the cam phaser 10 further includes a retention feature 40. In an exemplary embodiment, the retention feature acts to align the check valve plate 16 with an adjacent component in an angular position ("angular position" refers to the position in which the component sits relative to a rotational direction about the axial direction of the cam phaser 10).

In an exemplary embodiment, the retention feature 40 includes a plurality of tabs 42 and a plurality of indentations 44 which receive the tabs 42. In one embodiment, the tabs 42 are formed on and extend from a perimeter of the check valve plate 16. The indentations 44 are preferably formed on one or more of the stator 12, the locking cover 18, or the rear cover plate 21. The indentations 44 are preferably formed as axially-extending slots which are sized and shaped to receive the tabs 42 therein.

Figure 2:
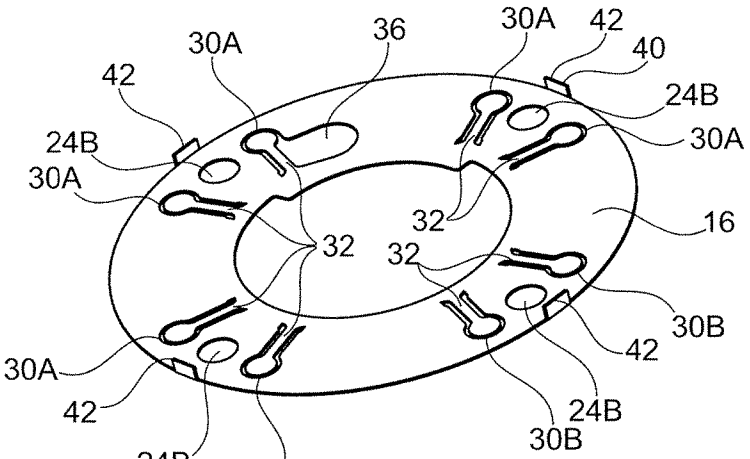
FIG. 2 is a perspective view of an exemplary check valve plate of the cam phaser of FIG. 1.

FIG. 2 further illustrates the check valve plate 16. The tabs 42 preferably extend from the perimeter of the check valve plate 16 and are bent to extend perpendicular to the plane of the body of the check valve plate 16. In other words, the tabs 42 extend in an axial direction (i.e., parallel to an axis of the cam phaser 10). The check valve plate 16 is preferably a stamped part with the bending of the tabs 42 being a step in the fabrication process (e.g., stamping process). In one embodiment, the check valve plate 16 includes four tabs 42. In some embodiments, each tab 42 is radially aligned with a corresponding first opening 24B.

Figure 3:
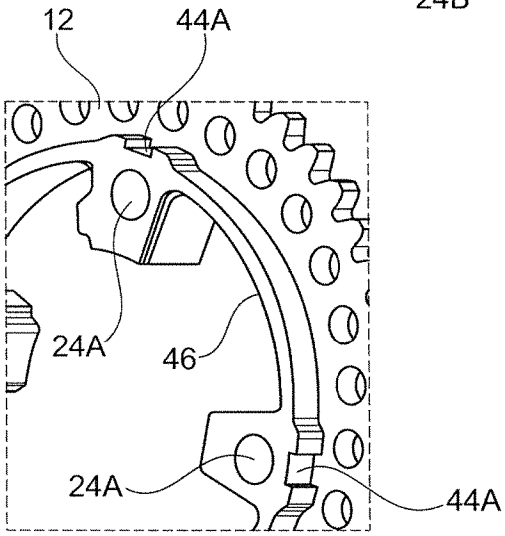
FIG. 3 is a perspective view of a portion of an exemplary stator of the cam phaser of FIG. 1.

FIG. 3 further illustrates a portion of the stator 12. The stator 12 preferably includes a rim portion 46. In embodiments in which the stator 12 includes the indentations 44, a plurality of indentations 44A are preferably formed in the rim portion 46. The indentations 44A are positioned to correspond to the position of the tabs 42 such that the tabs 42 are configured to be placed in the indentations 44A when the check valve plate 16 is properly positioned relative to the stator 12. In one embodiment, the stator 12 includes four indentations 44A which correspond to four tabs 42 of the check valve plate 16. As with the tabs 42, the four indentations 44A may be radially aligned with the first openings 24A of the stator 12.

Figure 4:
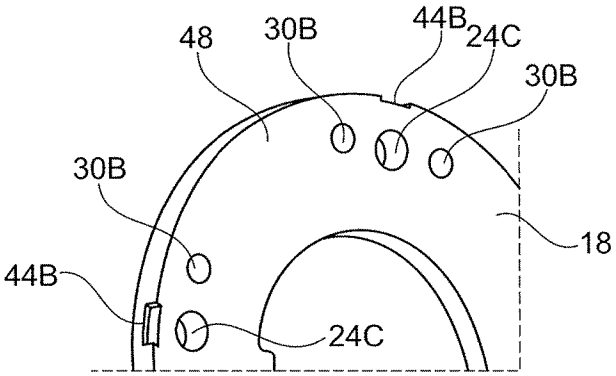
FIG. 4 is a perspective view of a portion of a locking cover of the cam phaser of FIG. 1.

FIG. 4 further illustrates a portion of the locking cover 18. In embodiments in which the locking cover 18 includes the indentations 44, a plurality of indentations 44B are preferably formed at a perimeter edge 48 of the locking cover 18. The indentations 44B are configured to receive the tabs 42 of the check valve plate 16 to connect the check valve plate 16 to the locking cover 18 in a properly aligned angular position. For example, the indentations 44B may be positioned such that when the tabs 42 are positioned in the indentations 44B, the second openings 30A, 30B are aligned with each other. Moreover, when a particular tab 42 is positioned in a corresponding indentation 44B, the third opening 36 is aligned with the receiving feature 38. In one embodiment, the locking cover 18 includes four indentations 44B which correspond to the four tabs 42. The four indentations 44B may be radially aligned with the first openings 24C. In an alternative embodiment in which the check valve plate 16 is positioned between the stator 12 and the rear cover plate 21, the rear cover plate 21 may include indentations much like those described above with respect to the locking cover 18.

The disclosed retention feature 40 includes a plurality of tabs 42 and at least one plurality of indentations 44. The tabs 42 may be inserted into the indentations 44 such that at least two components are connected to each other and held in a proper angular position while the remainder of the components are moved into position. For example, the check valve plate 16 may be connected to either the stator 12 or the locking cover 18 (or the rear cover plate 21), thereby inhibiting inadvertent rotation of the check valve plate 16 during an assembly process. In some embodiments, only one of the stator 12, the locking cover 18, and the rear cover plate 21 include the indentations 44, depending on the direction in which the tabs 42 are bent. Further, it should be understood that in alternative embodiments, the tabs 42 and/or indentations 44 may be reversed or rearranged. For example, the stator 12 and/or the locking cover 18 may include tabs while the check valve plate 16 may include indentations for receiving tabs.

In some embodiments, both the stator 12 and the locking cover 18 (or stator 12 and rear cover plate 21) include the indentations 44 (e.g., indentations 44A, 44B). In this way, the check valve plate 16 may be reversible such that the body of the check valve plate 16 can be selectively flipped to face in an opposite axial direction, thereby allowing the check valve plate 16 to function in different cam phaser configurations. For example, the tabs 42 of the check valve plate 16 may be inserted into the indentations 44A of the stator 12 such that the one-way valve elements 32 are arranged for an intake configuration and the same check valve plate 16 may be reversed with the tabs 42 inserted into the indentations 44B of the locking cover 18 so that the one-way valve elements 32 are arranged for an exhaust configuration. Similarly, this construction allows the same components to be used in different types of cam phasers without adjusting the fabrication processes of the respective components.

Figure 5B:
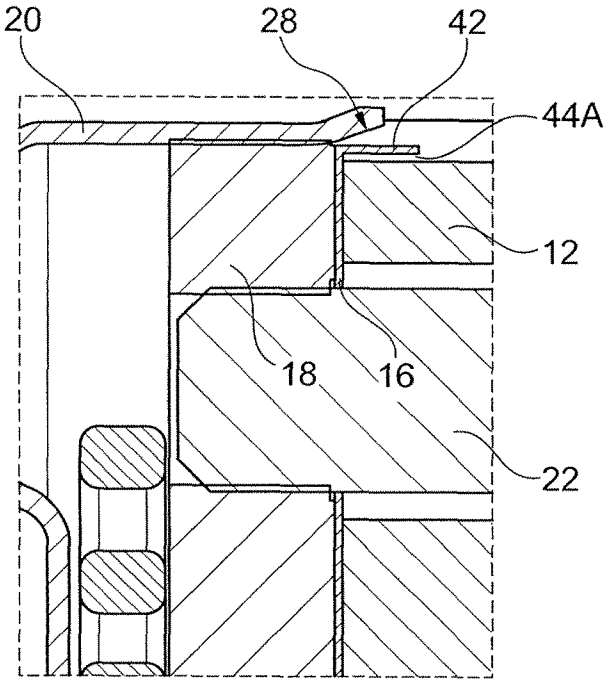
FIG. 5B is a cross-sectional view of a portion of the cam phaser of FIG. 1, including a second configuration of a retention feature.
Figure 5C:
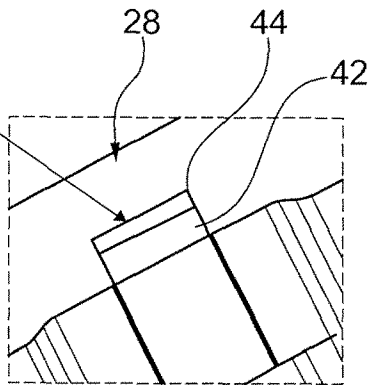
FIG. 5C is a close-up view of the retention feature that may be used in conjunction with the cam phaser of FIG. 1.
Figure 5A:
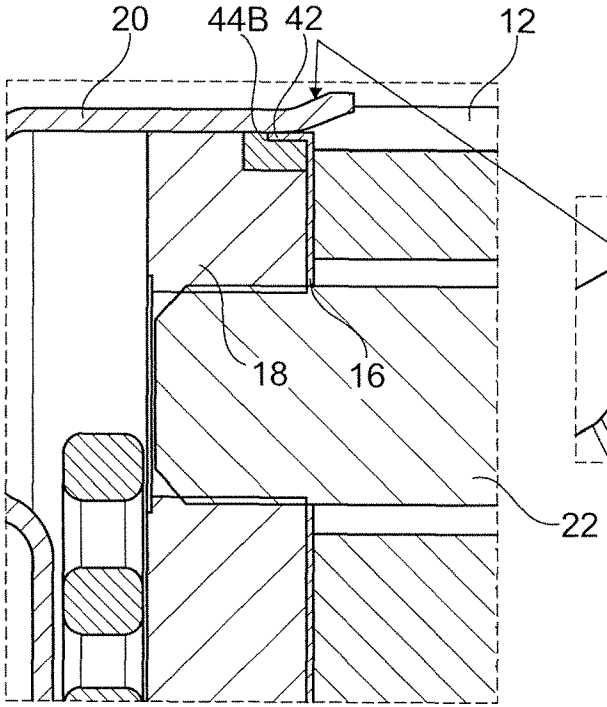
FIG. 5A is a cross-sectional view of a portion of the cam phaser of FIG. 1, including a first configuration of a retention feature.

FIGS. 5A and 5B illustrate partial cross-sectional views of the cam phaser 10 in the area of the retention feature 40. FIG. 5A illustrates a configuration in which the tabs 42 extend into the indentations 44B of the locking cover 18. FIG. 5B illustrates a configuration in which the tabs 42 extend into the indentations 44A of the stator 12. FIG. 5C further illustrates a tab 42 at least partially positioned in an indentation 44.

During an assembly process, the rotor 14 is positioned in the stator 12, the check valve plate 16 and the locking cover 18 are positioned over the rotor 14, the front and rear cover plates 20, 21 are moved into place, and the fasteners 22 are inserted through the aligned first openings 24A, 24B, 24C. In other words, the plurality of first openings 24A, 24B, 24C in the stator 12, locking cover 18, and check valve plate 16 are aligned for receiving a fastener 22, the plurality of second openings 30B are aligned with the valve elements 32 for forming at least a portion of a pressure-controlled fluid channel, and the third opening 36 in the check valve plate 16 is aligned with the receiving feature 38 in the locking plate 18 such that the locking pin 34 on the rotor 14 is configured to extend through the third opening 36 into the receiving feature 38.

During the course of the assembly, the tabs 42 are inserted into the indentations 44. When the configuration of FIG. 5B is used, this includes the tabs 42 being inserted into the indentations 44A of the stator 12. In this way, the check valve plate 16 is pre-aligned with respect to the stator 12 and held in that position while the locking cover 18 is moved into position and the fasteners 22 are inserted. When the configuration of FIG. 5A is used, the assembly includes the tabs 42 being inserted into the indentations 44B of the locking cover 18. In this way, the check valve plate 16 is pre-aligned with respect to the locking cover 18 such that these two components may be moved into position on the stator 12 as a sub-assembly.

Consistent with disclosed embodiments, the retention feature 40, including tabs 42 and indentations 44, simplifies an assembly process of the cam phaser 10. The retention feature 40 allows the check valve plate 16 to be connected to an adjacent component (the stator 12 or the locking cover 18) in an angular position which aligns the first openings 24B of the check valve plate 16 with either the first openings 24A of the stator 12 or the first openings 24C of the locking cover 18. In configurations in which the tabs 42 are inserted in the indentations 44B, the check valve plate 16 is connected to the locking cover 18 with the second openings 30B aligned with the valve elements 32 and the third opening 36 aligned with the receiving feature 38. In either configuration, the check valve plate 16 is inhibited from rotating to an unaligned positioned while other assembly steps are performed, thus providing a more efficient and effective assembly process of cam phaser 10.

PARTS LIST

10. Cam Phaser
12. Stator
14. Rotor
16. Check Valve Plate
18. Locking Cover
20. Front Cover Plate
21. Rear Cover Plate
22. Fastener
24A. First Opening
24B. First Opening
24C. First Opening
26. Lobe
28. Vane
30A. Cutout
30B. Second Opening
32. Valve Element
34. Locking Pin
36. Third Opening
38. Receiving Feature
40. Retention Feature
42. Tab
44. Indentation
44A. Indentation
44B. Indentation
46. Rim
48. Perimeter Edge

What is claimed is:

1. A cam phaser comprising:
a stator;
a rotor positioned in the stator and including a locking pin;
a locking cover including a receiving feature for receiving the locking pin;
a cover plate on an opposite side of the stator from the locking cover;
a check valve plate positioned between the stator and one of the locking cover or the cover plate, the check valve plate including a plurality of valve elements;
a plurality of first openings in each of the stator, locking cover, and check valve plate;
a plurality of second openings in the locking cover;
a third opening formed in the check valve plate; and
a retention feature for aligning components of the cam phaser during assembly, the retention feature including one or more tabs on the check valve plate and one or more indentations on a secondary component receiving the one or more tabs.

2. The cam phaser of claim 1, wherein the one or more tabs extend perpendicular to a plane of the check valve plate.

3. The cam phaser of claim 1, wherein the secondary component is the stator.

4. The cam phaser of claim 3, wherein the one or more indentations are formed in a rim of the stator.

5. The cam phaser of claim 1, wherein the secondary component is the locking cover.

6. The cam phaser of claim 5, wherein the one or more indentations are formed at a perimeter edge of the locking cover.

7. The cam phaser of claim 1, wherein the one or more indentations are formed in the stator and the locking cover.

8. The cam phaser of claim 7, wherein the one or more tabs extend into the one or more indentations of only one of the stator or the locking cover.

9. The cam phaser of claim 1, wherein the check valve plate is aligned with the stator and the locking cover such that the plurality of first openings are aligned for receiving a fastener; the plurality of second openings are aligned with the plurality of valve elements; and the third opening is aligned with the receiving feature such that the locking pin is configured to extend through the third opening into the receiving feature.

10. The cam phaser of claim 1, wherein the one or more tabs and the one or more indentations are radially aligned with the plurality of first openings.

11. The method of claim 10, wherein a third component also includes one or more indentations for receiving the one or more tabs and the one or more indentations of the third component remain empty after assembly of the cam phaser.

12. The method of claim 11, wherein the first component is the check valve plate, the second component is the stator, and the third component is the locking cover.

13. The method of claim 11, wherein the first component is the check valve plate, the second component is the locking cover, and the third component is the stator.

14. The cam phaser of claim 1, wherein the one or more tabs include a plurality of tabs and the one or more indentations include a plurality of indentations.

15. A method of assembling a cam phaser, the method comprising:

positioning a stator, a rotor, a locking cover, and a check valve plate with respect to each other such that:

a plurality of first openings in the stator, locking cover, and check valve plate are aligned for receiving a fastener, a plurality of second openings in the locking cover are aligned with a plurality of valve elements of the check valve plate; and a third opening in the check valve plate is aligned with a receiving feature in the locking plate such that a locking pin on the rotor is configured to extend through the third opening into the receiving feature, wherein positioning the check valve plate with at least one of the stator or the locking cover includes inserting one or more tabs on a first component into one or more indentations on a second component in order to align the first and second components with each other.

16. The method of claim 15, wherein the first component is the check valve plate and the second component is the stator.

17. The method of claim 16, wherein the one or more tabs extend perpendicular to a plane of the check valve plate into the one or more indentations, which are formed in a rim of the stator.

18. The method of claim 16, wherein the first component is the check valve plate and the second component is the locking cover.

19. The method of claim 18, wherein the one or more tabs extend perpendicular to a plane of the check valve plate.

* * * * *